US006780819B2

(12) United States Patent
Hara

(10) Patent No.: US 6,780,819 B2
(45) Date of Patent: Aug. 24, 2004

(54) HEAT SENSITIVE RECORDING MATERIAL

(75) Inventor: Toshio Hara, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 150 days.

(21) Appl. No.: 10/251,750

(22) Filed: Sep. 23, 2002

(65) Prior Publication Data

US 2003/0092572 A1 May 15, 2003

(30) Foreign Application Priority Data

Sep. 27, 2001 (JP) ..... 2001-296513

(51) Int. Cl.[7] ..... B41M 5/40
(52) U.S. Cl. ..... 503/200; 427/152; 503/226
(58) Field of Search ..... 503/200, 226; 427/152

(56) References Cited

U.S. PATENT DOCUMENTS

| | | | |
|---|---|---|---|
| 4,820,682 | A | 4/1989 | Shimomura et al. |
| 5,286,703 | A | 2/1994 | Wachi et al. |
| 6,028,029 | A | 2/2000 | Takeuchi |

FOREIGN PATENT DOCUMENTS

| | | |
|---|---|---|
| JP | 1-17479 | 3/1989 |

OTHER PUBLICATIONS

Japanese Abstract No. 60046295, dated Mar. 13, 1985.

*Primary Examiner*—Bruce H. Hess
(74) *Attorney, Agent, or Firm*—Sughrue Mion, PLLC

(57) ABSTRACT

A heat sensitive recording material includes a support having successively disposed thereon at least a heat sensitive recording layer and a protective layer, with the protective layer containing an ammonium salt of alkylsulfosuccinic acid.

16 Claims, No Drawings

HEAT SENSITIVE RECORDING MATERIAL

BACKGROUND OF THE INVENTION

1. Field of the Invention

The present invention relates to a heat sensitive recording material, and particularly to a heat sensitive recording material of high image quality suitable for a medical recording medium or the like.

2. Description of the Related Art

A heat sensitive recording method has advantages in that: (1) no development is needed; (2) when a support is paper, a recording material is close to plain paper; (3) handling is simple; (4) a color formation density is high; (5) a recording device is simple, highly reliable and inexpensive; (6) no noise is made at the time of recording; and (7) no maintenance is required. Therefore, the heat sensitive recording method has been recently developed in various fields and has been used extensively in, for example, the field of facsimile machines or printers, or the field of labeling such as Point of Sale (POS).

As a heat sensitive recording material used for the aforementioned heat sensitive recording, a material using a reaction between an electron-donating colorless dye and an electron-accepting compound, a material using a reaction between a diazo compound and a coupler, or the like has been conventionally and widely known.

Further, in recent years, there has been demanded development of heat sensitive recording material having a heat sensitive recording layer on a transparent support, which allows direct recording by a thermal head for the purpose of projecting an image or the like by an overhead projector, or directly observing an image or the like on a light table. Particularly, transparent heat sensitive recording material used for producing a diagnostic image for medical use has attracted the attention of those involved.

Such transparent heat sensitive recording materials have excellent transparency, but when printing is carried out therefor by a heat sensitive recording device such as a thermal printer, there exists a problem that sticking or noise is apt to be caused. Particularly, when a transparent heat sensitive recording material is used for medical application, a high transmission density is required. For this reason, heat energy applied by a thermal head increases, and problems such as sticking, noise generated at the time of recording, abrasion of a thermal head, and the like become serious. Accordingly, a protective layer containing, as principal components, a pigment and a binder is provided on a heat sensitive recording layer for the purpose of improving sticking and noise.

When a diagnostic image for medical use is prepared using a transparent heat sensitive recording material, an accurate diagnosis can be given so long as the image is clearly legible down to the smallest detail. However, a minute coating defect, which is caused when the protective layer is formed by coating, may have an adverse effect on an image to be formed. Thus, it is required that a so-called surface state is improved by preventing the aforementioned minute coating defect.

Further, when plastic material (vinyl chloride resin or the like) containing a plasticizer contacts an image portion after an image is formed on a heat sensitive recording material, the plasticizer contained in the plastic material transfers to the image portion and an image density may be lowered or color fading may be caused. Accordingly, the heat sensitive recording material needs to have resistance to a plasticizer (chemical resistance).

Japanese Patent Application Publication (JP-B) No. 1-17479 discloses that, due to 0.01 to 5 mass % of alkylsulfosuccinic acid being added to a heat sensitive recording material having a heat sensitive recording layer and a water-soluble resin layer on a support, coating property is improved while preventing a coating liquid from excessively permeating into the heat sensitive recording layer in the case of forming by coating the water-soluble resin layer. However, the aforementioned publication does not disclose a heat sensitive recording material having a heat sensitive recording layer formed on a transparent support. Further, there is not suggested therein that extremely strict surface state characteristics are required by a heat sensitive recording material for medical diagnosis, which is an example of the heat sensitive recording material.

SUMMARY OF THE INVENTION

The present invention has been devised in view of the aforementioned drawbacks, and an object of the present invention is to provide a heat sensitive recording material which has a good surface state and excellent solvent resistance, and also has excellent light resistance (in a background portion and an image portion) and storage characteristics of an image portion.

The present invention provides a heat sensitive recording material having, on a support, at least a heat sensitive recording layer and a protective layer in that order, which protective layer contains an ammonium salt of alkylsulfosuccinic acid.

The heat sensitive recording material of the present invention contains an ammonium salt of alkyl sufosuccinate in the protective layer, and therefore, minute coating defect caused when the protective layer is formed by coating is prevented and the surface state improves. Further, chemical resistance of the heat sensitive recording material according to the present invention is improved. Moreover, the heat sensitive recording material of the present invention has excellent light resistance in a background portion and an image portion, and also has image storability at a high temperature and under high humidity.

DESCRIPTION OF THE PREFERRED EMBODIMENTS

A heat sensitive recording material of the present invention will be hereinafter described in detail.

The heat sensitive recording material of the present invention has, on a support, a heat sensitive recording layer and a protective layer in that order, and if necessary, it also has other layers. The protective layer contains an ammonium salt of alkylsulfosuccinic acid. In the heat sensitive recording material of the present invention, since the protective layer contains an ammonium salt of alkylsulfosuccinic acid, minute coating defect caused when the protective layer is formed by coating is prevented and the surface state improves. Further, the heat sensitive recording material of the present invention is improved in chemical resistance. Moreover, the heat sensitive recording material of the present invention has excellent light resistance in a background portion and an image portion, and also has excellent image storability at a high temperature and under high humidity.

[Protective Layer]

The aforementioned protective layer is formed on the heat sensitive recording layer. Alternatively, when an intermediate layer is formed, as the other layer, on the heat sensitive recording layer, the protective layer is formed on the intermediate layer.

The protective layer is formed by applying a coating liquid for a protective layer thereto. As the ammonium salt of alkylsulfosuccinic acid to be added to the coating liquid for a protective layer, one represented by the following structural formula is particularly preferably used.

$$R_1OOC—CH_2—CH(COOR_2)\ (SO_3NH_4)$$

Wherein $R_1$ and $R_2$ each represent an alkyl group. The aforementioned alkyl group is not particularly limited, but preferably has 3 to 15 carbon atoms, and more preferably has 4 to 8 carbon atoms. Specific examples thereof include an isobutyl group, an amyl group, a hexyl group, a cyclohexyl group, an octyl group, 2-ethylhexyl group and the like. Among them, an octyl group and 2-ethylhexyl group are particularly preferable from the standpoint of obtaining a predetermined effect of the present invention. Further, a so-called symmetrical ammonium salt of alkylsulfosuccinic acid in which $R_1$ and $R_2$ are the same is preferable from the standpoint of obtaining a predetermined effect of the present invention.

The ratio of the ammonium salt of alkylsulfosuccinic acid to the total dry amount of the protective layer coated is not particularly limited, and preferably in the range of 5 to 21 mass %. If it is less than 5 mass %, an effect of improvement in the surface state, and effects of chemical resistance, light resistance and image storability are difficult to become visible. Further, if it exceeds 21 mass %, no more effect is obtained. Therefore, the aforementioned range is preferable.

The protective layer of the present invention, preferably, further contains water-insoluble particles. As the water-insoluble particles, various additives to be added to the protective layer, for example, a sticking inhibitor, mold releasing agent, lubricant, slip agent, surface gloss adjuster and a matting agent.

The sticking inhibitor is added for the purpose of preventing a thermal head from sticking to a heat sensitive recording material at the time of thermal recording, preventing adhesion of pieces of the recording material generated at the time of recording to a thermal head, or preventing generation of abnormal noise. Various types of pigments are used as the sticking inhibitor.

The pigment which can be used for the protective layer has a average particle size, specifically, a 50% volume median diameter measured by a laser diffraction method (that is, the median particle size of pigment particles in an amount corresponding to 50% volume of the total volume of the pigment, which is measured using an apparatus for measuring distribution of particle size by laser diffraction (trade name: LA700; manufactured by Horiba Ltd.; which may be hereinafter referred to simply as "average particle size") preferably in the range of 0.10 to 5.00 $\mu$m. Particularly, from the standpoint of preventing sticking between a thermal head and a heat sensitive recording material at the time of recording using the head, or preventing generation of abnormal noise, the 50% volume median diameter is more preferably in the range of 0.20 to 0.50 $\mu$m.

If the 50% volume median diameter is in the range of 0.10 to 5.00 $\mu$m, an effect of reducing abrasion of a thermal head is sufficiently obtained, and an effect of preventing welding of the thermal head and a binder in a protective layer is also sufficiently obtained. As a result, it is possible to effectively prevent sticking of a protective layer of a heat sensitive recording material to the thermal head at the time of printing.

The pigment contained in the protective layer is not particularly limited, and well-known organic and inorganic pigments can be used. Particularly, inorganic pigments such as calcium carbonate, titanium oxide, kaolin, aluminum hydroxide, amorphous silica and zinc oxide, and organic pigments such as urea-formalin resin and epoxy resin are preferable. Among them, kaolin, aluminum hydroxide and amorphous silica are more preferable. These pigments may be used alone or may be used in combination of two or more.

Further, the aforementioned pigment may be subjected to surface coating with at least one selected from a group consisting of higher fatty acid, metallic salt of higher fatty acid, and higher alcohol.

Examples of the higher fatty acid include stearic acid, palmitic acid, myristic acid and lauric acid.

These pigments are preferably used in a state of being dispersed so as to have the aforementioned average particle size by a well-known disperser such as a dissolver, a sand mill or a ball mill in the coexistence with a dispersing assistant such as sodium hexametaphosphorate, partially-saponified or completely-saponified modified polyvinyl alcohol, polyacrylate copolymer and various surface active agents, preferably partially-saponified or completely-saponified modified polyvinyl alcohol, or ammonium salt of polyacrylate copolymer. That is, the pigments are preferably used after dispersed so that the 50% volume median diameter thereof is in the range of 0.10 to 5.00 $\mu$m.

Further, as the aforementioned mold releasing agent, lubricant and slip agent, higher fatty acid (having 8 to 24 carbon atoms), metallic salt thereof, or amide compounds represented by the following structural formulae (1) to (3) are used. Preferred examples of the mold releasing agent include stearic acid, zinc stearate and stearic acid amide.

Structural Formula (1)

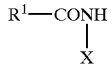

Structural Formula (2)

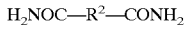

Structural Formula (3)

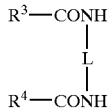

In the aforementioned structural formulae (1) to (3), X represents H or $CH_2OH$. $R^1$, $R^2$, $R^3$ and $R^4$ are each a saturated or unsaturated alkyl group having 8 to 24 carbon atoms, and may be branched or hydroxylated. $R^3$ and $R^4$ may be the same or different from each other.

L is represented by the following structural formula (4).

Structural Formula (4)

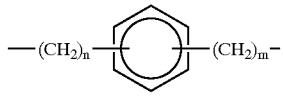

In the structural formula (4), n+m=0 to 8.

Among these compounds, the compounds represented by the structural formulae (1) and (3) are particularly preferable. $R^1$, $R^3$ and $R^4$ are each preferably a saturated or unsaturated alkyl group having 12 to 20 carbon atoms. The alkyl group may be branched or may have a hydroxy group. If h=0, n+m is 0 to 4, and particularly preferably 2. If h=1, n+m is preferably 0 to 2.

When the aforementioned mold releasing agent, lubricant or slip agent is solid, it is used: (1) in the form of water dispersions by a well-known disperser such as a homogenizer, a dissolver or a sand mill in the coexistence of a dispersing agent such as water-soluble high polymer, for example, polyvinyl alcohol, or various surface active agent; or (2) in the form of an emulsion by a well-known emulsifying device such as a homogenizer, a dissolver or a colloid mill in the coexistence of a dispersing agent such as water-soluble high polymer or various surface active agent after having been dissolved in a solvent.

When the mold releasing agent, lubricant or slip agent is liquid, it is used in the form of an emulsion as described above. The average particle size of the emulsion is preferably in the range of 0.1 to 5.0 $\mu$m, and further preferably in the range of 0.1 to 2 $\mu$m. The average particle size mentioned herein indicates 50% volume mean diameter measured by a laser diffraction particle size distribution measuring device (trade name: LA 700; manufactured by Horiba Ltd.) at a light transmittance of 75%±1%.

When the mold releasing agent, lubricant or slip agent is hydrophobic organic material, it is preferably used in a state of being dissolved in an organic solvent and emulsified. When the mold releasing agent or the like is used as an emulsion, water-insoluble grains exist, as droplet grains containing these materials, in the protective layer.

As the aforementioned surface gloss adjuster and matting agent, organic resin fine particles such as starch grains or polymethyl methacrylate resin, inorganic pigments and the like are used. They are used as a disperse system in the same manner as in the pigments used for preventing sticking.

When the water-insoluble grains to be contained in the protective layer are hydrophobic organic material, a plane defect is particularly apt to occur. Due to ammonium salt of alkylsulfosuccinic acid being added to the protective layer, occurrence of a plane defect can be effectively prevented.

Binder

The aforementioned protective layer preferably contains, as the binder, polyvinyl alcohol, carboxy-modified polyvinyl alcohol, silica-modified polyvinyl alcohol or the like from the standpoint of improving transparency.

Other Components

The aforementioned protective layer may contain a well-known film hardening agent or the like.

Further, for the purpose of preventing heat sensitive recording material from being charged, a surface active agent, metallic oxide fine grains, inorganic electrolyte, high molecular electrolyte or the like may also be added to the protective layer.

The protective layer may also have a single-layer structure or a layered structure comprised of two or more layers. The dry amount of the protective layer coated is preferably in the range of 0.2 to 7 g/m$^2$, and more preferably in the range of 1 to 4 g/m$^2$.

[Heat Sensitive Recording Layer]

The aforementioned heat sensitive recording layer contains at least a color forming component, and if necessary, it contains other components.

Color Forming Component

The aforementioned heat sensitive recording layer may contain components having any composition so long as they have excellent transparency before processed and have the property of forming a color by being heated.

As the heat sensitive recording layer as described above, a so-called two-component type heat sensitive recording layer containing a substantially colorless color forming component A and a substantially colorless color forming component B which reacts with the color forming component A to form a color. The color forming component A or color forming component B is preferably encapsulated in microcapsules. Examples of a combination of two components which form the two-component type heat sensitive recording layer include the following combinations (a) to (m).

(a) a combination of an electron-donating dye precursor and an electron-accepting compound (b) a combination of a photodegradable diazo compound and a coupler (c) a combination of organic metallic salt such as silver behenate or silver stearate, and a reducing agent such as protocatechinic acid, spiroindan or hydroquinone (d) a combination of long-chain aliphatic salt such as ferric stearate or ferric myristate, and phenols such as gallic acid or ammonium salicylate (e) a combination of heavy metal salt of organic acid such as nickel, cobalt, lead, copper, iron, mercury or silver salt of acetate, stearate or palmitate, and an alkali-earth metal sulfide such as calcium sulfide, strontium sulfide or potassium sulfide, or a combination of the aforementioned heavy metal salt of organic acid and an organic chelating agent such as 2-diphenylcarbazide or diphenylcarbazone (f) a combination of (heavy) metal sulphate such as silver sulfide, lead sulfide, mercury sulfide or sodium sulfide, and a sulfur compound such as sodium tetrathionate, sodium thiosulfate or thiourea (g) a combination of an aliphatic ferric salt such as ferric stearate, and an aromatic polyhydroxy compound such as 3,4-dihydroxytetraphenyl methane (h) a combination of organic precious metal salt such as silver oxalate or mercury oxalate, and an organic polyhydroxy compound such as polyhydroxy alcohol, glycerine or glycol (i) a combination of aliphatic ferric salt such as ferric pelargonate or ferric laurate, and a thiocecylcarbamide or isothiocecylcarbamide derivative (j) a combination of lead salt of organic acid such as lead caproate, lead pelargonate or lead behenate, and thiourea derivative such as ethylene thiourea or N-dodecylthiourea (k) a combination of a heavy metallic salt of higher fatty acid such as ferric stearate or copper stearate, and zinc dialkyldithiocarbamate (l) a combination of compounds which form an oxazine dye such as resorcinol and a nitroso compound (m) a combination of a formazan compound, and a reducing agent and/or metallic acid.

Among them, in the heat sensitive recording material of the present invention, the combination of an electron-donating dye presursor and an electron-accepting compound (the aforementioned (a)), the combination of a photodegradable diazo compound and a coupler (the aforementioned (b)), or the combination of organic metallic salt and a reducing agent (the aforementioned (c)) is preferably used. Particularly, the aforementioned combination (a) or (b) is more preferable.

Further, the heat sensitive recording material of the present invention can provide an image having excellent transparency by forming a heat sensitive recording layer so that a haze value obtained from a formula of (diffuse transmission factor/total light transmission factor)×100 (%) decreases. The haze value is an index which indicates the transparency of a material. Generally, the haze value is calculated, using a haze meter, from a total amount of light transmitted, an amount of light diffused and transmitted, and an amount of parallel transmitted light.

In the present invention, in order to decrease the haze value, for example, a method in which the 50% volume median diameter of the aforementioned color forming components A and B contained in the heat sensitive recording layer is 1.0 μm or less, preferably 0.6 μm or less, and a binder is contained in the range of 30 to 60 mass % based on the total solids of the heat sensitive recording layer, or a method in which one of the color forming components A and B is micro-encapsulated and after the other is applied and dried, a layer containing an encapsulated compound, for example, in the form of an emulsion is formed thereon substantially successively.

Further, a method in which refraction factors of components used for the heat sensitive recording layer are made to approach a fixed value as much as possible is also effective.

Next, the aforementioned combinations (a), (b) and (c) which are preferably used for the heat sensitive recording layer will be described in detail.

First, the combination of an electron-donating dye precursor and an electron-accepting compound (the aforementioned (a)) will be described.

The electron-donating dye precursor preferably used in the present invention is not particularly limited so long as it is substantially colorless. It is preferable to use a colorless compound which has the property of donating an electron or accepting a proton such as acid to form a color, and particularly, has a partial skeleton such as lactone, lactam, saltone, spiropyran, ester or amide, and when it contacts an electron-accepting compound, the partial skeleton causes ring opening or cleavage.

Examples of the electron-donating dye precursor include triphenylmethane phthalide compounds, fluorane compounds, phenothiazine compounds, indolylphthalide compounds, leucoauramine compounds, rhodaminelactam compounds, triphenylmethane compounds, triazene compounds, spiropyran compounds, fluorene compounds, pyridine compounds, and pyrazine compounds.

Specific examples of the aforementioned phthalides include compounds disclosed in U.S. Reissue Pat. No. 23,024, and U.S. Pat. Nos. 3,491,111, 3,491,112, 3,491,116 and 3,509,174.

Specific examples of the aforementioned fluorans include compounds disclosed in U.S. Pat. Nos. 3,624,107, 3,627,787, 3,641,011, 3,462,828, 3,681,390, 3,920,510 and 3,959,571.

Specific examples of the aforementioned spiropyrans include compounds disclosed in U.S. Pat. No. 3,971,808.

Examples of the aforementioned pyridine and pyrazine compounds include compounds disclosed in U.S. Pat. Nos. 3,775,424, 3,853,869 and 4,246,318.

Specific examples of the fluorene compounds include compounds disclosed in Japanese Patent Application No. 61-240989.

Among them, 2-arylamino-3-[H, halogen, alkyl or alkoxy-6-substituted aminofluoran] which forms black is particularly preferable.

Specifically, 2-anilino-3-methyl-6-diethylaminofluoran, 2-anilino-3-methyl-6-cyclohexyl-N-methylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-anilino-3-methyl-6-N-ethyl-N-isoamylaminofluoran, 2-anilino-3-methyl-6-N-ethyl-N-dodecylaminofluoran, 2-anilino-3-methoxy-6-dibutylaminofluoran, 2-o-chloroanilino-6-dibutylaminofluoran, 2-p-chloroanilino-3-ethyl-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-o-toluidino-3-methyl-6-diisopropylaminofluoran, 2-anilino-3-methyl-6-N-isobutyl-N-ethylaminofluoran, 2-anilino-3-methyl-6-N-ethyl-N-tetrahydrofurfurylaminofluoran, 2-anilino-3-chloro-6-N-ethyl-N-isoamylaminofluoran, 2-anilino-3-methyl-6-N-methyl-N-γ-ethoxypropylaminofluoran, 2-anilino-3-methyl-6-N-ethyl-N-γ-ethoxyropylaminofluoran, 2-anilino-3-methyl-6-N-ethyl-N-γ-propoxypropylaminofluoran, and the like are used.

As the electron-accepting compound acting on the electron-donating dye precursor, acid materials such as phenol compounds, organic acid or metallic salt thereof, oxybenzoate or the like are used. Examples thereof include compounds disclosed in Japanese Patent Application Laid-Open (JP-A) No. 61-291183 and the like.

Specifically, bisphenols such as 2,2-bis(4'-hydroxyphenyl)propane (common name: bisphenol-A), 2,2-bis(4'-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'-hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)octane, 1,1-bis(4'-hydroxyphenyl)-2-methyl-pentane, 1,1-bis(4'-hydroxyphenyl)-2-ethyl-hexane, 1,1-bis(4'-hydroxyphenyl)dodecane, 1,4-bis(p-hydroxyphenylcumyl)benzene, 1,3-bis(p-hydroxyphenylcumyl)benzene, bis(p-hydroxyphenyl)sulphone, bis(3-allyl-4-hydroxyphenyl) sulphone, and benzyl bis(p-hydroxyphenyl)acetate; salicylic acid derivatives such as 3,5-di-α-methylbenzyl salicylic acid, 3,5-di-tert-butyl salicylic acid, 3-α-α-dimethylbenzyl salicylic acid, and 4-β-p-methoxyphenoxyethoxy)salicylic acid, or polyvalent metallic salts thereof (particularly, zinc and aluminum are preferable); oxybenzoate such as benzyl p-hydroxybenzoate, 2-ethylhexyl p-hydroxybenzoate, and 2-phenoxyethyl β-resorcylate; phenols such as p-phenylphenol, 3,5-diphenylphenol, cumylphenol, 4-hydroxy-4'-isopropoxy-diphenylsulphone, and 4-hydoxy-4'-phenoxy-diphenylsulphone.

Among them, bisphenols are particularly preferable from the standpoint of obtaining excellent color forming property.

Further, the aforementioned electron-accepting compounds may be used alone or may be used in combination of two or more.

Next, the combination of a photodegradable diazo compound and a coupler (aforementioned (b)) will be described.

The aforementioned photodegradable diazo compound coupling-reacts with a coupler which is a coupling component (described later) to form a color of a desired color hue. The diazo compound is decomposed by being exposed to light of a specified wavelength region before the reaction, and does not any longer have a color forming ability even if the coupling component exists therein.

The color hue in the color forming system is determined by a diazo dye generated by a reaction between the diazo compound and the coupler. Accordingly, the color hue of the formed color can be readily changed by varying the chemical structure(s) of a diazo compound and/or a coupler, and an arbitrary color hue can be obtained depending on the combination.

The photodegradable diazo compound preferably used in the present invention is an aromatic diazo compound. Specifically, aromatic diazonium salt, diazosulfonate compound, diazoamino compound and the like are used.

The aforementioned aromatic diazonium salt may be a compound represented by the following general formula, but the present invention is not limited to the same. Further, as the aforementioned aromatic diazonium salt, a compound having excellent light fixation property, causing infrequent generation of colored stain after fixing, and having a stable color forming portion is preferably used.

$$Ar—N_2^+X^-$$

In the aforementioned formula, Ar represents an aromatic hydrocarbon ring group having a substituent, or an unsubstituted aromatic hydrocarbon ring group. $N_2^+$ represents a diazonium group and $X^-$ represents an acid anion.

As the aforementioned diazosulfonate compound, there are a large number of well-known compounds in recent years. The diazosulfonate compound is obtained by treating a corresponding diazonium salt with sulfite, and can be suitably used for the heat sensitive recording material of the present invention.

The aforementioned diazoamino compound can be obtained by causing a diazo group to coupling-react with dicyandiamide, sarcosine, methyltaurine, N-ethylanthranilic acid-5-sulfonic acid, monoethanolamine, diethanolamine or guanidine, and can be suitably used for the heat sensitive recording material of the present invention.

These diazo compounds are disclosed in, for example, JP-A No. 2-136286 in detail.

As the coupler which coupling-reacts with the diazo compound, 2-hydroxy-3-naphthoic acid anilide, resorcinol and other compounds disclosed in JP-A No. 62-146678 and the like are used.

When the combination of the diazo compound and the coupler is used in the aforementioned heat sensitive recording layer, a basic material may be added as a sensitizer from the standpoint of further facilitating the coupling reaction in a basic atmosphere.

As the basic material, a basic material which is insoluble in water or hard to be soluble therein, or a material which forms alkali by heating is used. Examples thereof include inorganic or organic ammonium salt, organic amine, amide, urea and thiourea, and derivatives thereof, and nitrogen-containing compounds such as thiazoles, pyrroles, pyrimidines, piperazines, guanidines, indoles, imidazoles, imidazolines, triazoles, morpholines, piperidines, amidines, forimazines, or pyridines.

Specific examples thereof include compounds disclosed in JP-A No. 61-291183 and the like.

Next, the combination of organic metallic salt and a reducing agent (aforementioned (c)) will be described.

Specific examples of the organic metallic salt include: silver salt of long-chain aliphatic carboxylic acid such as silver laurate, silver myristate, silver palmitate, silver stearate, silver arachate and silver behenate; silver salt of an organic compound having an imino group, such as benzotriazole silver salt, benzimidazole silver salt, carbazole silver salt or phthladinone silver salt; silver salt of a sulfur-containing compound, such as s-alkylthioglycolate; silver salt of aromatic carboxylic acid such as silver benzoate or silver phthalate; silver salt of sulfonic acid such as silver ethanesulfonate; silver salt of sulfinic acid such as silver o-toluenesulfinate; silver salt of phosphoric acid such as silver phenylphosphate; silver barbiturate; silver saccharate; silver salt of salicylasdoxym; and arbitrary mixtures thereof.

Among them, silver salt of long-chain aliphatic carboxylic acid is preferable, and silver behenate is more preferable. Further, behenic acid may also be used together with silver behenate.

As the aforementioned reducing agent, ones disclosed in JP-A No. 53-1020 (page 227, lower left column, line 14 to page 229, upper right column, line 11 can be suitably used. Among them, mono-, bis-, tris- or tetrakis-phenols, mono- or bis-naphtols, di or poly-hydroxynaphthalenes, di or poly-hydroxybenzenes, hydroxymonoethers, ascorbic acids, 3-pyrazolidones, pyrazolines, pyrazolones, reducing saccharides, phenylenediamines, hydroxylamines, reductones, hydrooxamic acids, hydrazides, amidoximes, N-hydroxyureas and the like are preferably used.

Particularly preferable are aromatic organic reducing agents such as polyphenols, sulfonamidephenols or naphthols.

In order to maintain sufficient transparency of the heat sensitive recording material, the combination of an electron-donating dye precursor and an electron-accepting compound (aforementioned (a)) or the combination of a photodegradable diazo compound and a coupler (aforementioned (b)) is preferably used for the heat sensitive recording material. Further, in the present invention, one of the aforementioned color forming components A and B is preferably micro-encapsulated, and the electron-donating dye precursor or photodegradable diazo compound is more preferably micro-encapsulated.

Microcapsule

Next, a description will be given of a method of producing microcapsules in detail.

An interfacial polymerization process, an internal polymerization process, external polymerization process or the like is used for production of microcapsules, and any of these processes can be used.

As described above, in the heat sensitive recording material of the present invention, the electron-donating dye precursor or photodegradable diazo compound is preferably micro-encapsulated. Particularly, it is preferable to use the interfacial polymerization process in which an oil phase, which is prepared by dissolving or dispersing the electron-donating dye precursor or the photodegradable diazo compound serving as a core of the capsule in a hydrophobic organic solvent, is mixed in an aqueous phase in which a water-soluble high polymer is dissolved, and emulsified by means of a homogenizer or the like, and thereafter, heated to cause a reaction to form a high polymer at an oil-droplet interface, thereby forming a microcapsule wall of high polymer material.

A reactant which forms the aforementioned high polymer is added to an interior of the oil-droplet and/or to an exterior of the oil-droplet. Specific examples of the high polymer material include polyurethane, polyurea, polyamide, polyester, polycarbonate, urea-formaldehyde resin, melamine resin, polystyrene, styrene-methacrylate copolymer, styrene-acrylate copolymer and the like. Among them, polyurethane, polyurea, polyamide, polyester and polycarbonate are preferable, and polyurethane and polyurea are particularly preferable.

For example, when polyurea is used as a capsule wall material, polyisocyanate such as diisocyanate, triisocyanate, tetraisocyanate or polyisocyanate prepolymer, and polyamine such as diamine, triamine or tetraamine, a prepolymer having two or more amino groups, piperazine or derivatives thereof, or polyol are made to react with each other by the interfacial polymerization process in the aforementioned aqueous phase, thereby making it possible to readily form a microcapsule wall.

For example, a composite wall comprised of polyurea and polyamide, or a composite wall comprised of polyurethane and polyamide can be prepared in such a manner that polyisocyanate and a second material (for example, acid chloride, polyamine, or polyol) which reacts with polyisocyanate to form a capsule wall are mixed into a water-soluble high polymer aqueous solution (aqueous phase) or in an oily medium (oil phase) to be encapsulated, and emulsified, and thereafter, heated. Details of the method for producing a composite wall comprised of polyurea and polyamide are disclosed in JP-A No. 58-66948.

The aforementioned polyisocyanate compound is preferably a compound having trifunctional or higher functional isocyanate groups, but a difunctional isocyanate compound may be used together.

Specifically, examples thereof include diisocyanate such as xylene diisocyanate and hydrogenated substance thereof, hexamethylene diisocyanate, tolylene diisocyanate and hydrogenated substance thereof, isophorone diisocyanate, a dimer or trimer of these compounds (buret or isocyanurate), an adduct of polyol such as trimethylol propane, and difunctional isocyanate such as xylene diisocyanate; a compound in which a high-molecular-weight compound, for example, polyether having active hydrogen such as polyethylene oxide is introduced in an adduct of polyol such as trimethylol propane, and difunctional isocyanate such as xylylene diisocyanate; formalin condensate of benzene isocyanate; and the like.

Compounds disclosed in JP-A Nos. 62-212190, 4-26189, 5-317694, and 10-114153, and the like are preferable.

The aforementioned polyisocyanate is preferably added so that the average particle size of microcapsules is in the range of 0.3 to 12 $\mu$m and the thicknesses of a capsule wall are in the range of 0.01 to 0.3 $\mu$m. The dispersion particle size is generally in the range of 0.2 to 10 $\mu$m.

Specific examples of polyol and/or polyamine to be added to an aqueous phase and/or an oil phase as one of constitutional components of a microcapsule wall, which reacts with polyisocyanate, include propylene glycol, glycerine, trimethylol propane, triethanol amine, sorbitol, hexamethylene diamine and the like. When polyol is added, a polyurethane wall is formed. In the aforementioned reaction, beneficially, a reaction temperature is maintained highly or an appropriate polymerization catalyst is added from the standpoint of increasing a reaction rate.

Polyisocyanate, polyol, reaction catalyst, and polyamine for forming a part of wall material are described in detail in "Polyurethane Handbook" (edited by Keiji Iwata, Nikkan Kogyo Shinbun-sha, 1987).

The aforementioned microcapsule wall may contain, if necessary, metal-containing dye, charge control agent such as nigrosine, or other arbitrary additive materials. These additives can be contained in the capsule wall at the time of forming a wall or at an arbitrary point of time. Further, in order to adjust the charging property of the surface of a capsule wall when necessary, a monomer such as vinyl monomer may be graft-polymerized.

Furthermore, in order that the micro-capsule wall may have excellent material permeability even at a lower temperature, a plasticizer suitable for a polymer used as a wall material is preferably used. The plasticizer preferably has a melting point of 50° C. or more, and preferably 120° C. or less. A plasticizer which is solid at an ordinary temperature can be suitably used.

For example, when the wall material is comprised of polyurea or polyurethane, a hydroxy compound, a carbamate ester compound, an aromatic alkoxy compound, an organic sulfonamide compound, an aliphatic amide compound, an arylamide compound and the like are suitably used.

In preparation of the aforementioned oil phase, as a hydrophobic organic solvent which causes an electron-donating dye precursor or photodegradable diazo compound to be dissolved therein and which is used as a core of microcapsules, an organic solvent having a boiling point of 100 to 300° C. is preferable.

Specifically, in addition to esters, dimethylnaphthalene, diethylnaphthalene, diisopropylnaphthalene, dimethylbiphenyl, diisopropylbiphenyl, diisobutylbiphenyl, 1-methyl-1-dimethylphenyl-2-phenylmethane, 1-ethyl-1-dimethylphenyl-1-phenylmethane, 1-propyl-1-dimethylphenyl-1-phenylmethane, triallylmethane (for example, tritoluylmethane, toluyldiphenylmethane), a terphenyl compound (for example, terphenyl), an alkyl compound, an alkylated diphenyl ether (for example, propyl diphenyl ether), hydrogenated terphenyl (for example, hexahydroterphenyl), and diphenyl ether are used. Among them, esters are particularly preferable from the standpoint of stability of emulsion.

Examples of the esters include phosphoric acid esters such as triphenyl phosphate, tricresyl phosphate, butyl phosphate, octyl phosphate and cresylphenyl phosphate; phthalic acid esters such as dibutyl phthalate, 2-ethylhexyl phthalate, ethyl phthalate, octyl phthalate and butylbenzyl phthalate; dioctyl tetrahydrophthalate; benzoic esters such as ethyl benzoate, propyl benzoate, butyl benzoate, isopentyl benzoate and benzyl benzoate; abietic acid esters such as ethyl abietate and benzyl abietate; dioctyl adipate; isodecyl succinate; dioctyl azelate; oxalic acid esters such as dibutyl oxalate and dipentyl oxalate; diethyl malonate; maleic acid esters such as dimethyl maleate, diethyl maleate and dibutyl maleate; tributyl citrate; sorbic acid esters such as methyl sorbate, ethyl sorbate and butyl sorbate; sebacic acid esters such as dibutyl sebacate and dioctyl sebacate; ethylene glycol esters such as formic acid monoester and diester, butylic acid monoester and diester, lauric acid monoester and diester, palmitic acid monoester and diester, stearic acid monoester and diester, and oleic acid monoester and diester; triacetin; diethyl carbonate; diphenyl carbonate; ethylene carbonate; propylene carbonate; and boric acid esters such as tributyl borate and tripentyl borate.

Among them, it is particularly preferable that tricresyl phosphate is used alone or mixedly from the standpoint of obtaining the most excellent stability of emulsion. It is possible that the same kind of oils may be used or that different kinds of oils may be used together.

When the solubility of the electron-donating dye precursor or photodegradable diazo compound, which is to be capsulated, to the aforementioned hydrophobic organic solvent is inferior, a low-boiling-point solvent in which the electron-donating dye precursor or photodegradable diazo compound has a high solubility can be auxiliary used together. As the low-boiling-point solvent, for example, ethyl acetate, isopropyl acetate, butyl acetate and methylene chloride are preferably used.

When the aforementioned electron-donating dye precursor or photodegradable diazo compound is used for a heat sensitive recording layer of a heat sensitive recording material, the amount of the electron-donating dye precursor contained is preferably in the range of 0.1 to 5.0 g/m$^2$, and more preferably in the range of 1.0 to 4.0 g/m$^2$.

Further, the amount of photodegradable diazo compound contained is preferably in the range of 0.02 to 5.0 g/m$^2$, and more preferably in the range of 0.10 to 4.0 g/m$^2$ from the standpoint of color forming density.

If the amount of the electron-donating dye precursor contained is in the range of 0.1 to 5.0 g/m$^2$, a sufficient color forming density is obtained. Further, if amounts of the electron-donating dye precursor and photodegradable diazo compound are within 5.0 g/m$^2$, a sufficient color forming density is maintained and transparency of the heat sensitive recording layer can be held.

An aqueous solution, in which a water-soluble high polymer is dissolved as a protective colloid, is used as an aqueous phase to be used, and the oil phase is added to the aqueous solution, and thereafter, emulsion dispersion is performed by a homogenizer or the like. The water-soluble high polymer allows homogeneous and simple dispersion and functions as a dispersion medium for stabilizing the emulsified aqueous solution. In order that the aqueous solution be further homogeneously emulsified and stabilized, a surface active agent may be added to at least one of the oil phase and the aqueous phase. As the surface active agent, a well-known surface active agent for emulsification can be used. The amount of the surface active agent added is preferably in the range of 0.1 to 5% based on the mass of the oil phase, and more preferably in the range of 0.5 to 2%.

As the surface active agent to be contained in the aqueous phase, one which do not act on the protective colloid and do not cause precipitation or aggregation can be suitably selected among from anionic or nonionic surface active agents.

Preferred examples of the surface active agent include sodium alkylbenzenesulfonate, sodium alkylsulfate, dioctyl sodium sulfosuccinate, and polyalkylene glycol (for example, polyoxyethylene nonylphenyl ether).

The emulsification can be easily performed by dispersing an oil phase containing the aforementioned components, and an aqueous phase containing a protective colloid and a surface active agent using a means for usual fine grain emulsification such as high-speed agitation, ultrasonic dispersion or the like, for example, a homogenizer, a Manton-Gaulin, an ultrasonic disperser, a dissolver, a Keddy mill, or a well-known emulsifier. After the emulsification, the emulsion is preferably heated to a temperature of 30 to 70° C. for the purpose of facilitating a reaction for formation of a capsule wall. Further, in order to prevent aggregation of capsules during reaction, preferably, water is added to decrease a probability of collision between capsules or the emulsion is agitated sufficiently.

A dispersed substance for preventing aggregation may also be added during a reaction. Generation of carbon dioxide is observed as polymerization reaction proceeds, and the end of the generation can be regarded as an end point of a reaction for formation of a capsule wall. Usually, due to a reaction continuing for several hours, intended microcapsules can be obtained.

Emulsion

When capsules are formed with electron-donating dye precursor or photodegradable diazo compound serving as a core material, an electron-accepting compound or coupler to be used may be solid-dispersed, together with water-soluble high polymer and organic base, and other color forming assistants, using a sand mill or the like. However, more preferably, the aforementioned electron-accepting compound or coupler is in advance dissolved in a high-boiling-point organic solvent, which is hard to be soluble or insoluble in water, and thereafter, mixed with a high polymer aqueous solution (aqueous phase) containing a surface active agent and/or, as the protective colloid, water-soluble high polymer, and emulsified by a homogenizer into an emulsion. In this case, if necessary, a low-boiling-point solvent can also be used as a solubilizer.

Further, a coupler and an organic base may be separately emulsified, or may be mixed together and dissolved in a high-boiling-point organic solvent, and thereafter, emulsified. A preferred particle size of emulsion grains is in the range of 1 $\mu$m or less.

The high-boiling-point organic solvent used in this case can be appropriately selected from, for example, high-boiling-point oils disclosed in JP-A No. 2-141279.

Among them, esters are preferably used from the standpoint of stability of an emulsion. It is particularly preferable that tricresyl phosphate is used. It is possible that the same kind of oils may be used or that different kinds of oils may be used together.

The aforementioned water-soluble high polymer contained as the protective colloid can be appropriately selected from a group consisting of well-known anionic high polymers, nonionic high polymers and amphoteric high polymers. A water-soluble high polymer having a solubility of 5% or more to water set at a temperature required for emulsification is preferable. Specific examples thereof include polyvinyl alcohol or modified substances thereof, polyacrylate amide or derivatives thereof, ethylene-vinyl acetate copolymer, styrene-maleic anhydride copolymer, ethylene-maleic anhydride copolymer, isobutylene-maleic anhydride copolymer, polyvinyl pyrolidone, ethylene-acrylate copolymer, vinyl acetate-acrylate copolymer, cellulose derivatives such as carboxymethyl cellulose and methyl cellulose, casein, gelatin, starch derivatives, gum arabic, sodium alginate and the like.

Among them, polyvinyl alcohol, gelatin and cellulose derivatives are particularly preferable.

The mixing ratio of the oil phase to the aqueous phase (that is, mass of oil phase/mass of aqueous phase) is preferably in the range of 0.02 to 0.6, and more preferably 0.1 to 0.4. If the mixing ratio is in the range of 0.02 to 0.6, a moderate viscosity can be maintained and excellent manufacturing suitability and excellent stability of a coating liquid are obtained.

When the electron-accepting compound is used in the heat sensitive recording material of the present invention, it is preferably contained in the range of 0.5 to 30 parts by mass based on one part by mass of the aforementioned electron-donating dye precursor, and more preferably in the range of 1.0 to 10 parts by mass.

Further, when the coupler is used in the heat sensitive recording material of the present invention, it is preferably contained in the range of 0.1 to 30 parts by mass based on 1 part by mass of the diazo compound.

Coating Liquid for Heat Sensitive Recording Layer

A coating liquid for a heat sensitive recording layer can be prepared by, for example, mixing the microcapsule liquid prepared as described above, and an emulsion. In this case, the water-soluble high polymer used as a protective colloid when the aforementioned microcapsule liquid is prepared, and the water-soluble high polymer used as a protective colloid when the aforementioned emulsion is prepared, each function as a binder in the heat sensitive recording layer. Further, a coating liquid for a heat sensitive recording layer may contain a binder in addition to the protective colloid.

The binder to be added is generally soluble in water. Examples thereof include polyvinyl alcohol, hydroxyethyl cellulose, hydroxypropyl cellulose, epichlorohydrin-modified polyamide, ethylene-maleic anhydride copolymer, styrene-maleic anhydride copolymer, isobutylene-maleic anhydride copolymer, polyacrylate, polyacrylic acid amide, methylol-modified polyacrylamide, starch derivatives, casein, gelatin and the like.

In order that these binders may each have water resistance, a waterproof agent, an emulsion comprised of a hydrophobic polymer, such as styrene-butadiene rubber latex, acrylic resin emulsion or the like can also be added.

When the aforementioned coating liquid for a heat sensitive recording layer is applied to a support, a well-known coating means used for a water type or organic solvent based coating liquid is used. In this case, for the purpose of stably and homogeneously applying the coating liquid for a heat sensitive recording layer and maintaining the strength of a coating film, the heat sensitive recording material of the present invention may use methyl cellulose, carboxymethyl cellulose, hydroxyethyl cellulose, starches, gelatin, polyvinyl alcohol, carboxy-modified polyvinyl alcohol, polyacrylamide, polystyrene or copolymers thereof, polyester or copolymers thereof, polyethylene or copolymers thereof, epoxy resin, acrylic resin or copolymers thereof, methacrylic resin or copolymers thereof, polyurethane resin, polyamide resin, polyvinyl butyral resin or the like.

Other Components

Next, other components which can be used for the heat sensitive recording layer will be described.

The other components are not particularly limited, and can be appropriately selected according to purposes. For example, well-known heat fusible materials, ultraviolet absorbents and antioxidants are used.

The aforementioned heat fusible materials can be contained in the heat sensitive recording layer for the purpose of improving thermal responsiveness.

Examples of the heat fusible materials include aromatic ether, thioether, ester, aliphatic amide, ureide and the like.

These examples are disclosed in JP-A Nos. 58-57989, 58-87094, 61-58789, 62-109681, 62-132674, 63-151478, 63-235961, 2-184489 and 2-215585.

As the aforementioned ultraviolet absorbent, benzophenone ultraviolet absorbent, benzotriazole ultraviolet absorbent, salicylic acid ultraviolet absorbent, cyanoacrylate ultraviolet absorbent, oxalic acid anilide ultraviolet absorbent, and the like are suitably used. Examples thereof are disclosed in JP-A Nos. 47-10537, 58-111942, 58-212844, 59-19945, 59-46646, 59-109055 and 63-53544, JP-B Nos. 36-10466, 42-26187, 48-30492, 48-31255, 48-41572, 48-54965 and 50-10726, U.S. Pat. Nos. 2,719,086, 3,707,375, 3,754,919 and 4,220,711, and the like.

As the aforementioned antioxidant, hindered amine antioxidant, hindered phenol antioxidant, aniline antioxidant, quinoline antioxidant, and the like are suitably used. Examples thereof are disclosed in JP-A Nos. 59-155090, 60-107383, 60-107384, 61-137770, 61-139481 and 61-160287, and the like.

The amount of the aforementioned other components coated is preferably in the range of 0.05 to 1.0 g/m$^2$, and more preferably in the range of 0.1 to 0.4 g/m$^2$. The other components may also be added inside or outside of the microcapsules.

In order that a high-quality image be obtained by controlling density unevenness caused by a small difference in heat conduction of a thermal head, the aforementioned heat sensitive recording layer has, preferably, a wide range of energy amount required for obtaining a saturated transmission density ($D_{T\text{-}max}$), that is, a wide dynamic range. The present invention has the heat sensitive recording layer as described above, and the heat sensitive recording layer preferably has the property of being capable of obtaining a transmission density $D_T$ of 3.0 in the range of heat energy amount of 90 to 150 mJ/mm$^2$.

The aforementioned heat sensitive recording layer is preferably applied so that a dry amount of the coating liquid after coated and dried becomes 1 to 25 g/m$^2$ and the thickness of the layer becomes 1 to 25 $\mu$m. The heat sensitive recording layer can be used with two or more layers being formed into a layered structure. In this case, the total dry amount of all heat sensitive recording layers after coated and dried is preferably in the range of 1 to 25 g/m$^2$.

[Support]

In the heat sensitive recording material of the present invention, a transparent support is preferably used to form a transparent heat sensitive recording material. As the transparent support, synthetic high polymer films, for example, a polyester film such as polyethylene terephthalate or polybutylene terephthalate, a cellulose triacetate film, or a polyolefin film such as polypropylene or polyethylene are used. These films may be used alone or may be used by laminating.

Thickness of the aforementioned synthetic high polymer film is preferably in the range of 25 to 250 $\mu$m, and more preferably in the range of 50 to 200 $\mu$m.

Further, the aforementioned synthetic high polymer film may be colored an arbitrary color hue. In order to color the high polymer film, a method in which a resin film is formed after a dye is kneaded in resin, a method in which a coating liquid with a dye dissolved in an appropriate solvent is applied to a transparent colorless resin film using a well-known coating process, for example, gravure coating, roller coating or wire coating, and the like are used. Among them, preferable is a method in which polyester resin such as polyethylene terephthalate or polyethylene naphthalate, with a blue dye kneaded therein, is formed into a film, and the film is subjected to heat resisting treatment, drawing and antistatic treatment.

Particularly, when the transparent heat sensitive recording material of the present invention is observed from the side of the support on Schaukasten, dazzling is caused by Schaukasten light passing through a transparent non-image portion and an image becomes illegible.

In order to solve the aforementioned drawback, as the transparent support, a synthetic high polymer film is particularly preferable, which is colored blue within a square region formed by four points: A (x=0.2805, y=0.3005); B (x=0.2820, y=0.2970); C (x=0.2885, y=0.3015); and D (x=0.2870, y=0.3040) on chromaticity coordinates defined by a method based on JIS-Z8701.

[Other Layers]

In the heat sensitive recording material of the present invention, an intermediate layer, an undercoat layer, an ultraviolet filter layer, an antireflection layer and the like can be provided, as the other layers, on the aforementioned support.

Intermediate Layer

The aforementioned intermediate layer is preferably formed on the heat sensitive recording layer.

The intermediate layer is provided so as to prevent mixing of layers or cut-off of gas (oxygen or the like) which is harmful for image storability. A binder to be used is not particularly limited, and polyvinyl alcohol, gelatin, polyvinyl pyrolidone, cellulose derivative or the like can be used depending on a system. Various surface active agents may also be added to provide coating suitability. Further, inorganic fine grains such as mica may be added in the range of 2 to 20 mass %, preferably in the range of 5 to 10 mass % to the binder for the purpose of further improving a gas barrier property.

Undercoat Layer

In the heat sensitive recording material of the present invention, for the purpose of preventing peeling of the heat sensitive recording layer from the support, an undercoat layer may be provided on the support before the heat sensitive recording layer containing a microcapsules and the like, or an antireflection layer is applied.

As the aforementioned undercoat layer, an acrylic ester copolymer, polyvinylidene chloride, SBR, aqueous polyester or the like can be used. The thickness of the undercoat layer is preferably in the range of 0.05 to 0.5 μm.

When the heat sensitive recording layer is applied to the undercoat layer, the undercoat layer swells due to water contained in the coating liquid for a heat sensitive recording layer, and an image recorded on the heat sensitive recording layer may deteriorate accordingly. Therefore, the undercoat layer is preferably hardened using a film hardener, for example, dialdehydes such as glutaraldehyde, 2,3-dihydroxy-1,4-dioxane, and boric acid. The amount of the film hardener added is set in the range of 0.2 to 3.0 mass % according to the mass of the undercoat materials, and may be suitably added depending on a desired hardness.

Ultraviolet Filter Layer

An ultraviolet filter layer may be provided on a rear surface of the support, which is located opposite to a surface with the heat sensitive recording layer applied thereto, for the purpose of preventing fading of an image. The ultraviolet filter layer contains a benzotriazole, benzophenone or hindered amine ultraviolet absorbent.

Antireflection Layer

An antireflection layer containing fine grains whose average particle size is in the range of 1 to 20 μm, preferably 1 to 10 μm may be provided on a rear surface of the support, which is located opposite to a surface with the heat sensitive layer applied thereto.

Due to application of the antireflection layer, a glossiness measured at an angle of incidence of 20 degrees is preferably set to be 50% or less, and more preferably set to be 30% or less.

As the fine grains contained in the aforementioned antireflection layer, in addition to fine grains such as starches obtained from barley, wheat, corn, rice or beans, fine grains of synthetic high polymer such as cellulose fiber, polystyrene resin, epoxy resin, polyurethane resin, urea-formalin resin, poly(meth)acrylate resin, polymethyl(meth)acrylate resin or vinyl chloride (or acetate) copolymer, polyolefin, inorganic fine grains such as calcium carbonate, titanium oxide, kaolin, smectite clay, aluminum hydroxide, silica or zinc oxide, and the like are used.

These fine grains may be used alone or may be used in combination of two or more. Further, it is preferable to use fine grains having a refractive index of 1.45 to 1.75 from the standpoint of improving transparency of the heat sensitive recording material.

Thermal Head

A thermal head used by a heat sensitive recording system of the present invention is formed in such a manner that a protective layer is provided on a heating element having a heating resistor and an electrode on a glaze layer using a well-known film forming device so that a carbon content of an uppermost layer contacting the heat sensitive recording material becomes 90% or more. The protective layer of the head may be comprised of two or more layers, but it is necessary that at least the uppermost layer should have a carbon content of 90% or more.

The heat sensitive recording material of the present invention can be suitably produced by a method for producing a heat sensitive recording material of the present invention, which will be described later. However, the present invention is not limited to the same, and the heat sensitive recording material may also be produced by other production methods.

Next, a description will be given of the method for producing a heat sensitive recording material of the present invention.

In the method for producing a heat sensitive recording material of the present invention, a coating liquid for forming a heat sensitive recording layer is applied to a support to form a heat sensitive recording layer, and a coating liquid for forming a protective layer is applied to the heat sensitive recording layer to form a protective layer. If necessary, other layers are further formed.

The heat sensitive recording layer and the protective layer may be formed at the same time. In this case, the coating liquid for forming a heat sensitive recording layer, and the coating liquid for forming a protective layer are simultaneously applied to the support in a multi-layered form, and the heat sensitive recording layer and the protective layer to be formed thereon can be formed at the same time.

As the support to be used herein, the support described above and used for the heat sensitive recording material of the present invention may be used. Further, as the coating liquid for forming a heat sensitive recording layer, the aforementioned coating liquid for a heat sensitive recording layer may be used. Moreover, as the coating liquid for forming a protective layer, the aforementioned coating liquid for a protective layer containing a pigment and a binder can be used.

Furthermore, the aforementioned other layers may include the aforementioned intermediate layer, undercoat layer and the like.

In the method for producing a heat sensitive recording material of the present invention, a well-known coating method such as blade coating, air-knife coating, gravure coating, roll coating, spray coating, dip coating or bar coating is used to sequentially form the undercoat layer, the heat sensitive recording layer, intermediate layer, protective layer and the like on the support.

Specifically, various coating operations including extrusion coating, slide coating, curtain coating, dip coating, knife coating, flow coating and extrusion coating using a hopper disclosed in U.S. Pat. No. 2,681,294 are used. Among them, extrusion coating or slide coating disclosed in "Liquid Film Coating" (by Stephen F. Kistler, Petert M. Schweizer, published by Chapman & Hall, 1997, on pages 399 to 536) is preferably used. Particularly preferable is slide coating. An example of the shape of a slide coater used by slide coating is disclosed in the aforementioned publication (on page 427, FIG. 11*b*.1). Further, if necessary, two or more layers may be simultaneously applied using a method disclosed in the aforementioned publication (on pages 399 to 536) and methods disclosed in U.S. Pat. No. 2,761,791 and British Patent No. 837,095.

The method for producing a heat sensitive recording material of the present invention allows production of the aforementioned heat sensitive recording material of the present invention.

EXAMPLES

The present invention will be further illustrated with reference to the following examples, but it is not limited to these examples. In the examples, "%" means "mass %".

Example 1

[Preparation of Coating Liquid for a Protective Layer]

Preparation of Pigment Dispersion Liquid for a Protective Layer

To 110 g of water, 30 g of aluminum hydroxide treated with stearic acid (trade name: HIGILITE H42S; manufactured by Showa Denko K.K.) was added as a pigment, and the mixture was stirred for 3 hours. Then, 0.8 g of an auxiliary dispersant (trade name: POISE 532A; manufactured by Kao Corp.), 30 g of a 10% by mass aqueous solution of polyvinyl alcohol (trade name: PVA105; manufactured by Kuraray Co., Ltd.) and 10 g of a 2% by mass aqueous solution of a compound represented by the following structural formula were added, and the mixture was dispersed by a sand mill to obtain a pigment dispersion liquid for a protective layer having an average particle size of 0.30 $\mu$m.

The average particle size was measured in such a manner that: pigments to be used were dispersed in the presence of an auxiliary dispersant; the pigment dispersion immediately after the pigment was dispersed was diluted to the concentration of 0.5% by mass by adding water; the obtained solution for measurement was placed in water of 40° C.; the light transmittance was adjusted to 75±1.0%, and thereafter, the solution for measurement was subjected to ultrasonic vibration for 30 seconds and was then subjected to measurement by an apparatus for measuring distribution of particle diameter by laser diffraction (trade name: LA700; manufactured by Horiba Ltd.); and the average particle diameter of pigment particles in an amount corresponding to 50% by volume of the total volume of the pigment was used as the average particle size. All values of the average particle size used hereinafter were obtained as described above.

[100]

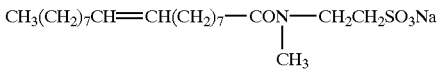

Preparation of Coating Liquid for a Protective Layer

To 65 g of water, 90 g of an 8% by mass aqueous solution of polyvinyl alcohol (trade name: PVA124C; manufactured by Kuraray Co., Ltd.), 5.5 g of a 20.5 by mass dispersion of zinc stearate (trade name: F-115; manufactured by Chukyo Yushi Co., Ltd.), 3.8 g of a 21.5% by mass stearic acid amide compound (trade name: G-270; manufactured by Chukyo Yushi Co., Ltd.), 2.8 g of a 18.0% by mass stearic acid (trade name: Serosol920; manufactured by Cyukyo Yushi Co., Ltd.), 10 g of a 4% aqueous solution of boric acid, 70 g of the aforementioned pigment dispersion liquid for a protective layer (18% by mass), 4.7 g of a 35% by mass dispersion of silicone oil in water (polydimethylsiloxane, trade name: BY22-840 manufactured by Toray Dow Corning Co., Ltd.), 6.5 g of a 10 mass % aqueous solution of sodium dodecylbenzenesulfonate, 3.28 g of ammonium di-2-ethylhexylsulfosuccinate (a 175% liquid of Nissan Electrol SAL manufactured by NOF Corporation), 17.5 g of 6% by mass aqueous solution of styrene-maleic acid copolymer ammonium salt (trade name: Polymaron 385; manufactured by Arakawa Chemical Industry Co., Ltd.), 14 g of a 20% colloidal silica (trade name: Snowtex; manufactured by Nissan Chemical Industries, Ltd.), 16 g of a 10% Sarfron S131S (manufactured by Seimi Chemical Co., Ltd.), 1.1 g of Plysurf A 217 (manufactured by Dai-ichi Kogyo Seiyaku Co., Ltd.), and 8 g of 2% acetic acid were mixed together to obtain a coating liquid for a protective layer.

[Preparation of Coating Liquid for a Heat Sensitive Recording Layer]

Microcapsule liquids and developer emulsion were each prepared as described below.

Preparation of Microcapsules A

To 24.3 g of ethyl acetate, 11.7 g of a compound represented by the following structural formula [201], 1.5 g of a compound represented by the following structural formula [202], 2.2 g of a compound represented by the following structural formula [203], 5.65 g of a compound represented by the following structural formula [204], 1.2 g of a compound represented by the following structural formula [205], 1.1 g of a compound represented by the following structural formula [206], and 0.57 g of a compound represented by the following structural formula [207] were added as color forming agents and dissolved by heated to 70° C., and thereafter, cooled to 45° C. To the cooled solution, 13.1 g of a material for a capsule wall (trade name: Takenate D14ON; manufactured by Takeda Chemical Industries, Ltd.) and 2.3 g of Barnock D750 (manufactured by Dainippon Ink & Chemicals, Inc.) were added and mixed.

[201]

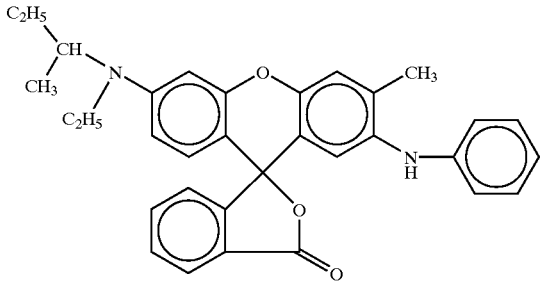

[202]

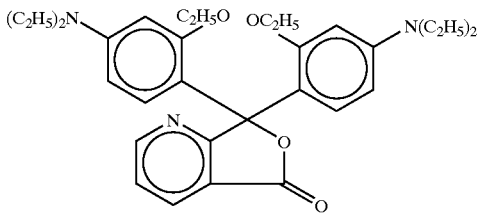

[203]

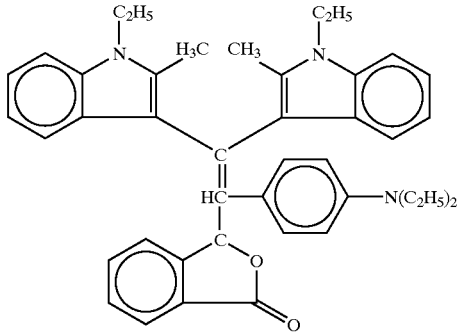

[204]

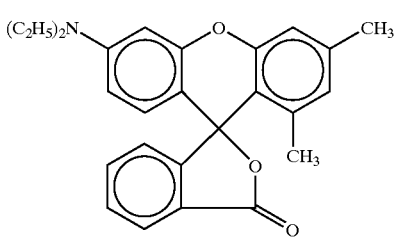

-continued

[205]

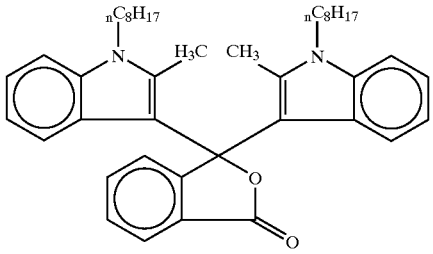

[206]

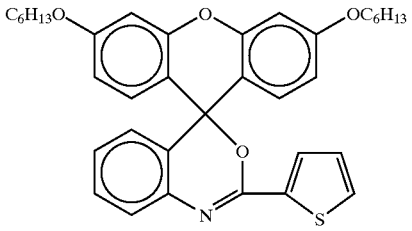

[207]

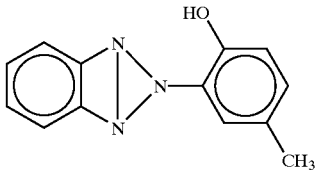

The resultant solution was added to an aqueous phase in which 48 g of an 8% by mass aqueous solution of polyvinyl alcohol (trade name: PVA217C manufactured by Kuraray Co., Ltd.) was mixed into 16 g of water, and thereafter, emulsified for 5 minutes using an ACE HOMOGENIZER (manufactured by Nippon Seiki Co., Ltd.) at a rotation speed of 15000 rpm. To the obtained emulsion, 110 g of water and 1.0 g tetraethylenepentamine were added, and thereafter, a reaction for formation of capsules was carried out at 60° C. for 4 fours to prepare a coating liquid of microcapsule (concentration of solid content: 23%) having an average particle size of 0.35 μm.

Preparation of Microcapsules B

To 21 g of ethyl acetate, 12.2 g of a compound represented by the structural formula [201], 1.6 g of a compound represented by the structural formula [202], 2.4 g of a compound represented by the structural formula [203], 3.3 g of a compound represented by the structural formula [204], 1.5 g of a compound represented by the structural formula [205], 0.2 g of a compound represented by the structural formula [206] and 0.5 g of a compound represented by the structural formula [207] were added and dissolved by being heated to 70° C., and thereafter, cooled to 35° C. To the cooled solution, 0.5 g of n-butanol, 14.1 g of Takenate D127N (manufactured by Takeda Chemical Industries, Ltd.), and 2.5 g of Takenate D110N (manufactured by Takeda Chemical Industries, Ltd.), and kept at 35° C. for 40 minutes.

The resultant solution was added to an aqueous phase in which 48.1 g of an 8% by mass polyvinyl alcohol (PVA217C, manufactured by Kuraray Co., Ltd.) was added to 16.6 g of water, and emulsified using an ACE HOMOGENIZER (manufactured by Nippon Seiki Co., Ltd.) at a rotation speed of 15000 rpm for 5 minutes. To the obtained emulsion, 112 g of water and 0.9 g of tetraethylenepentamine were further added, and thereafter, a reaction for formation of capsules was carried out at 60° C. for 4 hours. As a result, a coating liquid of microcapsule having an average particle size of 0.35 μm (concentration of solid content: 24%) was prepared.

Preparation of Developer Micro-Emulsion

To 16.5 of ethyl acetate, 6.7 g of a compound represented by the following structural formula [301], 8.0 g of a compound represented by the following structural formula [302], 5.8 g of a compound represented by the following structural formula [303], 1.5 g of a compound represented by the following structural formula [304], 2.2 g of a compound represented by the following structural formula [305], 0.8 g of a compound represented by the following structural formula [306], and 4.3 g of a compound represented by the following structural formula [307] were added, as developers, together with 1.0 g of tricresyl phosphate and 0.5 of diethyl maleate, and dissolved by being heated to 70° C.

[301]

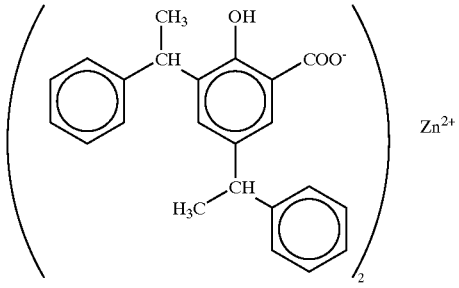

[302]

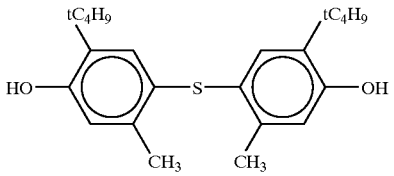

[303]

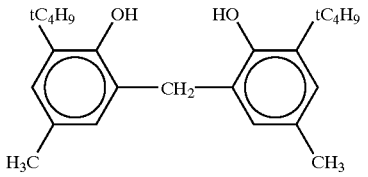

[304]

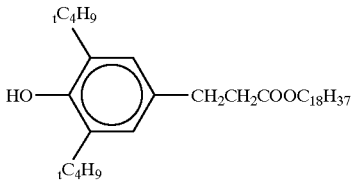

[305]

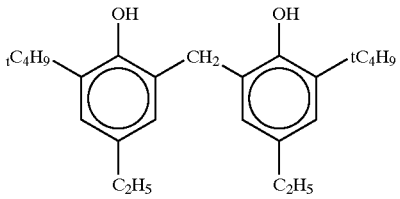

-continued

[306]

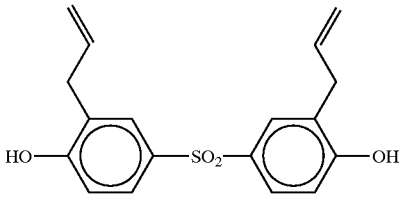

[307]

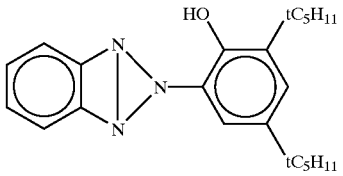

The resultant solution was added to an aqueous phase in which 70 g of water, 57 g of an 8% by mass aqueous solution of polyvinyl alcohol (PVA217C manufactured by Kuraray Co., Ltd.), 20 g of a 15% by mass aqueous solution of polyvinyl alcohol (trade name: PVA205C manufactured by Kuraray, Co. Ltd.), and 11.5 g of a 2% by mass aqueous solution of compounds represented by the following structural formulae [401] and [402] were mixed together.

[401]

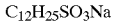

[402]

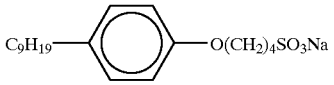

Thereafter, the resultant mixture was emulsified using an ACE HOMOGENIZER (manufactured by Nippon Seiki Co., Ltd.) at a rotation speed of 10000 rpm so that the average particle size became 0.7 μm, and a developer emulsion (concentration of solid content: 22%) was obtained.

Preparation of a Coating Liquid A for a Heat Sensitive Recording Layer 12 g of the aforementioned microcapsules A, 2.5 g of the aforementioned microcapsules B, 50 g of the aforementioned developer emulsion, 0.7 g of a 50% by mass aqueous solution of a compound represented by the following structural formula [403], and 1.8 g of colloidal silica (Snowtex, manufactured by Nissan Chemical Industries, Ltd.) were mixed together to prepare a coating liquid A for a heat sensitive recording layer.

[403]

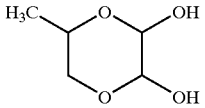

<Preparation of a Coating Liquid B for a Heat Sensitive Recording Layer>

2.3 g of microcapsules A, 6.6 g of microcapsules B, 33 g of developer emulsion, 1.5 g of colloidal silica (Snowtex, manufactured by Nissan Chemical Industries, Ltd.), and 0.4 g of a 50% by mass aqueous solution of the compound represented by the structural formula [403] were mixed together to prepare a coating liquid B for a heat sensitive recording layer.

<Preparation of a Coating Liquid C for a Heat Sensitive Recording Layer>

35 g of a 6% by mass aqueous solution of PVA (trade name: PVA 124C; manufactured by Kurarary Co., Ltd.), 2 g of a 2% aqueous solution of a compound represented by the following structural formula [404], and 0.5 g of microcapsules A were dissolved in 5 g of water to prepare a coating liquid C for a heat sensitive recording layer.

[404]

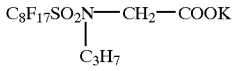

<Preparation of a Coating Liquid for a Back (BC) Layer>

Water was added to 1 kg of lime-treated gelatin, 757 g of gelatin dispersion containing a 12% by mass spherical PMMA matting agent having an average particle size of 5.7 μm, and 3761 g of an emulsion of ultraviolet absorbent containing compounds represented by the following structural formulae [501] to [505] by the following contents (the amounts of ultraviolet absorbents contained for 1 kg of the emulsion are set as follows:

compound represented by formula [501]: 9.8 g compound represented by formula [502]: 8.4 g compound represented by formula [503]: 9.8 g compound represented by formula [504]: 13.9 g compound represented by formula [505]: 29.3 g 1,2-benzisothiazoline-3-one-poly(sodium p-vinylbenzenesulfonate) (molecular weight: about 400000): 64.2 g compound represented by formula [506]: 10.0 g 20% latex liquid of polyethyl acrylate: 3180 ml N,N-ethylene-bis(vinylsulfonylacetoamide): 75.0 g 1,3-bis(vinylsulfonylacetoamide)propane: 25.0 g)

The resultant mixture was prepared so that the total amount became 62.77 L.

[501]

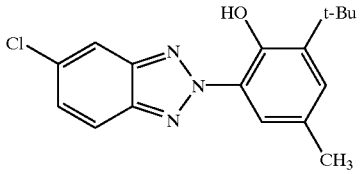

[502]

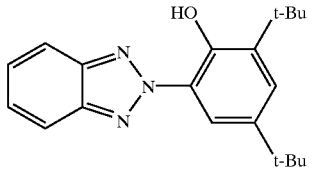

[503]

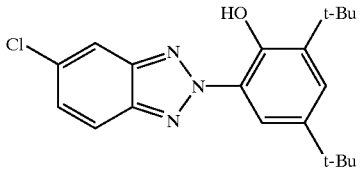

-continued

[504]

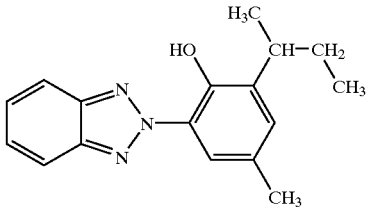

[505]

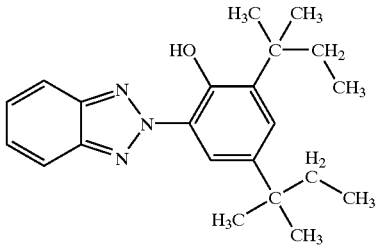

[506]

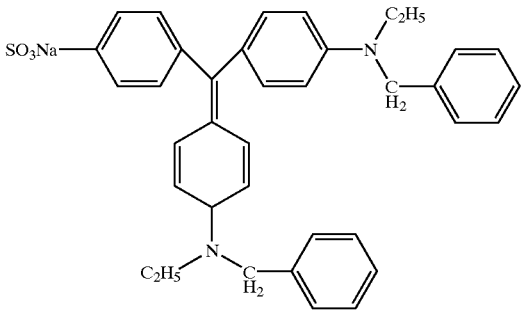

<Preparation of Coating Liquid for a Back Protective (BPC) Layer>

1 kg of lime-treated gelatin, 2000 g of gelatin dispersion containing a 15% by mass % spherical PMMA matting agent having an average particle size of 0.70 μm, 1268 ml of methanol, 1.75 g of 1,2-benzisothiazoline-3-one, 64.4 g of sodium polyacrylate (molecular weight: about 100000), 54.0 g of poly(sodium p-vinylbenzenesulfonate) (molecular weight: about 400000), 25.2 g of p-t-octylphenoxypolyoxyethylene-sodium ethylsulfonate, 5.3 g of N-propyl-N-polyoxyethylene-perfluorooctanesulfonic acid amide-sodium butylsulfonate, and 7.1 g of potassium perfluorooctanesulfonate were mixed and the pH of the resultant mixture was adjusted to 7.0 with caustic soda, and thereafter, water was added thereto so that the total amount became 66.79 L.

The aforementioned coating liquid for a BC layer and coating liquid for a BPC layer were applied on a transparent PET support (thickness: 180 μm), which was dyed blue whose chromaticity coordinate defined by a method based on JIS-Z8701 was represented by x=0.2850 and y=0.2995, simultaneously in a layered form using a slide bead system in the order of the coating liquid for a BC layer and the coating liquid for a BPC layer so that the coated amounts of the coating liquid for a BC layer and the coating liquid for a BPC layer became 44.0 ml/m$^2$ and 18.5 ml/m$^2$, respectively, and the applied coating liquids were dried. The coating and drying conditions are as follows.

The coating rate was set at 160 m/min., and a clearance between an end of coating die and a support was set in the range of 0.10 to 0.30 mm. The pressure of a decompression chamber was set to be lower than the ambient pressure by 196 to 882 Pa. The support was discharged by ion air before coating.

Subsequently, in a chilling zone, the coating liquid was cooled by air having a dry-bulb temperature of 10 to 20° C., and thereafter, the support was transported in a non-contact manner and dried by dry air having a dry-bulb temperature of 23 to 45° C. and having a wet-bulb temperature of 15 to 21° C. using a helix contactless drying device.

[Preparation of a Heat Sensitive Recording Material]

Liquids A, B and C for a heat sensitive color forming layer, and a coating liquid for a protective layer were simultaneously applied by a slide bead system in a layered manner on a surface of the support opposite to a surface on which the BC layer is provided, so that the coating amounts thereof became 50 ml/m$^2$, 20 ml/m$^2$, 25 ml/m$^2$ and 25 ml/m$^2$, and then dried. As a result, a transparent heat sensitive recording material of the present invention was obtained. The coating and drying conditions are as follows.

The coating rate was set at 160 m/min., and a clearance between an end of coating die and a support was set in the range of 0.10 to 0.30 mm. The pressure of a decompression chamber was set to be lower than the ambient pressure by 196 to 882 Pa. The support was discharged by ion air before coating.

In a subsequent first drying zone, the support was subjected to initial drying with air having a dry-bulb temperature of 40 to 60° C. and a dew point of 0° C., and thereafter, further dried by a helix contactless drying device with dry air having a wet-bulb temperature of 23 to 45° C. and a relative humidity of 20 to 70% RH while being transported in a contactless manner.

The amount of ammonium salt of di-2-ethylhexylsulfosuccinate contained in the solid content of the protective layer was 7.2%.

Recording was carried out for the obtained heat sensitive recording material by a thermal head (trade name: KGT, 260-12MPH8; manufactured by Kyocera Corp.) under a head pressure of 10 kg/cm$^2$ with a recording energy of 85 mJ/mm$^2$. Thereafter, the following evaluation was made. The results are shown in Table 1.

<Plane Defect Evaluation Method>

In the plane defect evaluation, 5 sheets of solid printing sample recorded with 85 mJ, each having a size of B4, was visually inspected. A very small microscopic splash generating portion is inspected as a sensitized spot compared with a peripheral normal portion, and therefore, the frequency at which black-spot defects of 0.5 mm or more in diameter are produced was counted for each sheet of B4 size and average was obtained.

<Evaluation Method for Chemical Resistance A>

The sample, after printed using a printing tester (manufactured by Kyocera Corp.), was wrapped with a food wrap (a wrap of polyvinyl chloride) and allowed to stand for 30 days in an atmosphere at a temperature of 23° C. and humidity of 65%. Thereafter, a change in the sample was visually inspected.

<Evaluation Method for Chemical Resistance B>

The sample, after printed using a printing tester (manufactured by Kyocera Corp.), was wrapped with a food wrap (a wrap of polyvinyl chloride) and allowed to stand in a state of being pressurized by a glass plate for 7 days in an atmosphere at a temperature of 40° C. and humidity of 60%. Thereafter, a change in the sample was visually inspected.

[Evaluation Criteria]

AA: no change was found

A: a change was recognized although substantially no discoloration occurred

B: no problem arises in reading of a printed portion although discoloration slightly occurred C: reading of a printed portion was possible although discoloration and blurring occurred D: discoloration and blurring occurred, reading of a printed portion was difficult, by which a problem would practically arises <Light Resistance Evaluation Method>

The sample was irradiated with light from a heat sensitive surface thereof continuously for 2 weeks by a fluorescent-lamp tester (32000 lux, in an atmosphere of about 35° C.), and thereafter, visually compared with an unprocessed sample. The criteria for evaluation are as follows.

AA: no change was found

A: almost no change was found, but color deterioration of an image, or discoloration of a background portion could be visually recognized B: a change was found both in image and background portions, but image gradation was maintained.

C: color deterioration of an image, and coloring of a background portion were clearly recognized, but reading of an image was still possible.

D: color deterioration of an image, and coloring of a background portion were both found in a wide range, and a change in the image is great, by which a problem would practically arise.

<Image Storability Evaluation Method>

A sample adjusted at an initial transmission density of 1.2 was allowed to stand for two weeks in an atmosphere of 40° C. and 90% RH, and thereafter, taken out, and the image density was measured and a difference from an initial density was calculated. The transmission density was measured by a device for measuring transmission density (RD912 type; manufactured by Macbeth) under a visual filter condition.

Example 2

A heat sensitive recording material was prepared in the same manner as in Example 1 except that the liquid of ammonium salt of di-2-ethylhexylsulfosuccinate was changed to 2.45 g (5.5% of the solid content of the protective layer) in the coating liquid for a protective layer in Example 1.

Example 3

A heat sensitive recording material was prepared in the same manner as in Example 1 except that the liquid of ammonium salt of di-2-ethylhexylsulfosuccinate was changed to 2.10 g (4.7% of the solid content of the protective layer) in the coating liquid for a protective layer in Example 1.

Example 4

A heat sensitive recording material was prepared in the same manner as in Example 1 except that the liquid of ammonium salt of di-2-ethylhexylsulfosuccinate was changed to 1.8 g (4.1% of the solid content of the protective layer) in the coating liquid for a protective layer in Example 1.

Example 5

A heat sensitive recording material was prepared in the same manner as in Example 1 except that the liquid of ammonium salt of di-2-ethylhexylsulfosuccinate was changed to 1.60 g (3.7% of the solid content of the protective layer) in the coating liquid for a protective layer in Example 1.

Example 6

A heat sensitive recording material was prepared in the same manner as in Example 1 except that the liquid of ammonium salt of di-2-ethylhexylsulfosuccinate was changed to 9.50 g (18.4% of the solid content of the protective layer) in the coating liquid for a protective layer in Example 1.

Comparative Example 1

A heat sensitive recording material was prepared in the same manner as in Example 1 except that the liquid of ammonium salt of di-2-ethylhexylsulfosuccinate was changed to 3.2 g (4.8% of the solid content of the protective layer) of a 50% solution (a mixed solvent having a volume ratio between water and methanol of 1:1) of sodium salt of di-2-ethylhexylsulfosuccinate (Nissan Rapizole B90, manufactured by NOF Corp.) in the coating liquid for a protective layer in Example 1.

Comparative Example 2

A heat sensitive recording material was prepared in the same manner as in Comparative Example 1 except that the amount of the solution of comparative example 1 was changed to 2.4 g (3.7% of the solid content of the protective layer) in Comparative Example 1.

Comparative Example 3

A heat sensitive recording material was prepared in the same manner as in Comparative Example 1 except that the amount of the solution of comparative example 1 was changed to 3.8 g (5.8% of the solid content of the protective layer) in Comparative Example 1.

The heat sensitive recording materials of Examples 2 to 6 and Comparative Examples 1 to 3 were evaluated in the same manner as in Example 1. The results are shown in Table 1.

TABLE 1

| | Content of $NH_4$ alkylsulfosuccinate or metallic salt in a protective layer | Light resistance (WM discoloration) | Image storability ΔOD (40° C./90% RH) | Plane defect evaluation: number of black spots (for B4 size) | Anti-plasticizer Chemical resistance A | Anti-plasticizer Chemical resistance B |
|---|---|---|---|---|---|---|
| Example 1 | 7.2 | A | 0.10 | 22 | A | B |
| Example 2 | 5.5 | A | 0.07 | 24 | B | C |
| Example 3 | 4.7 | A | 0.07 | 102 | C | D |

TABLE 1-continued

| | Content of $NH_4$ alkylsulfosuccinate or metallic salt in a protective layer | Light resistance (WM discoloration) | Image storability ΔOD (40° C./90% RH) | Plane defect evaluation: number of black spots (for B4 size) | Anti-plasticizer Chemical resistance A | Anti-plasticizer Chemical resistance B |
|---|---|---|---|---|---|---|
| Example 4 | 4.1 | A | 0.05 | 210 | C | D |
| Example 5 | 3.7 | AA | 0.04 | 410 | C | D |
| Example 6 | 18.4 | A | 0.11 | 11 | A | B |
| Comparative Example 1 (*1) | 4.8 | D | 0.25 | 120 | C | D |
| Comparative Example 2 (*2) | 3.7 | C | 0.21 | 397 | C | D |
| Comparative Example 3 (*3) | 5.8 | D | 0.27 | 26 | B | C |

*1, *2 and *3: sodium salt of alkylsulfosuccinic acid was used.

What is claimed is:

1. A heat sensitive recording material comprising a support having successively disposed thereon at least a heat sensitive recording layer and a protective layer, wherein the protective layer contains greater than or equal to 7.2% by mass based on the solid content of the protective layer of an ammonium salt of alkylsulfosuccinic acid.

2. The heat sensitive recording material of claim 1, wherein the amount of the ammonium salt contained is 7.2 to 21% by mass based on the solid content of the protective layer.

3. The heat sensitive recording material of claim 2, wherein the protective layer further contains water-insoluble grains.

4. The heat sensitive recording material of claim 3, wherein the water-insoluble grains are at least one selected from the group consisting of sticking inhibitors, mold releasing agents, lubricants, slip agents, surface gloss control agents and matting agents.

5. The heat sensitive recording material of claim 4, wherein the support is a high polymer film.

6. The heat sensitive recording material of claim 3, wherein the water-insoluble grains are droplet grains containing hydrophobic organic material.

7. The heat sensitive recording material of claim 6, wherein the support is a high polymer film.

8. The heat sensitive recording material of claim 2, wherein the support is a high polymer film.

9. The heat sensitive recording material of claim 3, wherein the support is a high polymer film.

10. The heat sensitive recording material of claim 1, wherein the protective layer further contains water-insoluble grains.

11. The heat sensitive recording material of claim 10, wherein the water-insoluble grains are at least one selected from the group consisting of sticking inhibitors, mold releasing agents, lubricants, slip agents, surface gloss control agents and matting agents.

12. The heat sensitive recording material of claim 11, wherein the support is a high polymer film.

13. The heat sensitive recording material of claim 10, wherein the water-insoluble grains are droplet grains containing hydrophobic organic material.

14. The heat sensitive recording material of claim 13, wherein the support is a high polymer film.

15. The heat sensitive recording material of claim 10, wherein the support is a high polymer film.

16. The heat sensitive recording material of claim 1, wherein the support is a high polymer film.

* * * * *